US008479676B2

(12) United States Patent
Kurpiewski

(10) Patent No.: US 8,479,676 B2
(45) Date of Patent: Jul. 9, 2013

(54) CONTROLLED TOWED ARRAY DEPRESSOR

(75) Inventor: Thaddeus J. Kurpiewski, Manlius, NY (US)

(73) Assignee: Lockheed Martin Corporation, Bethesda, MD (US)

( * ) Notice: Subject to any disclaimer, the term of this patent is extended or adjusted under 35 U.S.C. 154(b) by 258 days.

(21) Appl. No.: 12/412,151

(22) Filed: Mar. 26, 2009

(65) Prior Publication Data

US 2010/0242823 A1 Sep. 30, 2010

(51) Int. Cl.
*B63G 8/14* (2006.01)

(52) U.S. Cl.
USPC ..... 114/245

(58) Field of Classification Search
USPC ..... 114/244, 245, 249; 367/15–18
See application file for complete search history.

(56) References Cited

U.S. PATENT DOCUMENTS 3,062,171 A * 11/1962 Somerville ..... 114/245
3,137,264 A * 6/1964 Brainard, II et al. ..... 114/244
3,613,626 A * 10/1971 Kelly et al. ..... 114/244
3,939,468 A 2/1976 Mastin
4,599,712 A 7/1986 Chelminski
4,757,482 A 7/1988 Fiske, Jr.
5,000,110 A 3/1991 Moore
5,168,471 A 12/1992 Parra
5,443,027 A 8/1995 Owsley et al.
5,532,975 A * 7/1996 Elholm ..... 367/16
5,949,214 A 9/1999 Broussard et al.
6,142,092 A 11/2000 Coupland
6,533,627 B1 3/2003 Ambs
6,901,876 B2 * 6/2005 Geriene et al. ..... 114/244
6,985,403 B2 1/2006 Nicholson
7,167,412 B2 1/2007 Tenghamn
7,404,370 B2 * 7/2008 Stokkeland ..... 114/253
7,881,152 B2 * 2/2011 Storteig et al. ..... 367/16
2003/0060102 A1 3/2003 Ambs
2004/0196737 A1 10/2004 Nicholson
2006/0133199 A1 6/2006 Tenghamn
2006/0133200 A1 6/2006 Tenghamn
2008/0008033 A1 1/2008 Fossum et al.

* cited by examiner

*Primary Examiner* — Edwin Swinehart
(74) *Attorney, Agent, or Firm* — Howard IP Law Group, PC

(57) ABSTRACT

A depressor for towed hydrophone arrays is contemplated having a remotely controllable tow point to allow array depth to be modified without requiring manual reconfiguration. The tow cable is attached to the depressor in an adjustable manner also providing improved depth control precision.

9 Claims, 8 Drawing Sheets

CONTROLLED TOWED ARRAY DEPRESSOR

FIELD OF THE INVENTION

The present invention relates generally to towed hydrophone arrays and particularly to depressors used to control the depth of towed hydrophone arrays.

BACKGROUND

Systems for controlling water depth of a towed hydrophone array currently include critical angle towed array systems and depressor towed array systems. Towed arrays in critical angle towed array systems are connected to a ship by a tow cable of varying length. The depth of the array may be controlled by simply varying the length of the tow cable as well as by changing ship speed. Accordingly, array depth is highly dependent on ship speed and tow cable length. Depressor towed array systems incorporate an additional element called a depressor for controlling the depth of the hydrophone array. The depressor is located between a tow cable of varying length and the towed hydrophone array. The depressor includes wing-like projections whose angle of attack affects the depth of the depressor. This feature allows the depth of the towed array to be increased with a shorter cable length than was possible with critical angle towed array systems. The angle of attack of the wing-like projections, and in turn the depth of the depressor, may be controlled by changing the preset angle of the wing-like projections. The angle of attack may also be controlled by modifying the position of a tow point, the point at which the tow cable attaches to the depressor, relative to the center of gravity of the depressor. Current systems require that depressor towed arrays be brought onboard ship and manually reconfigured to change the angle of attack and in turn the depth of the towed array. Therefore, while current depressors reduce the dependence on ship speed and cable length associated with critical angle systems, significant reconfiguration time is introduced.

DETAILED DESCRIPTION

Reference will now be made in detail to the present exemplary embodiments of the invention, examples of which are illustrated in the accompanying drawings.

Figure 1:
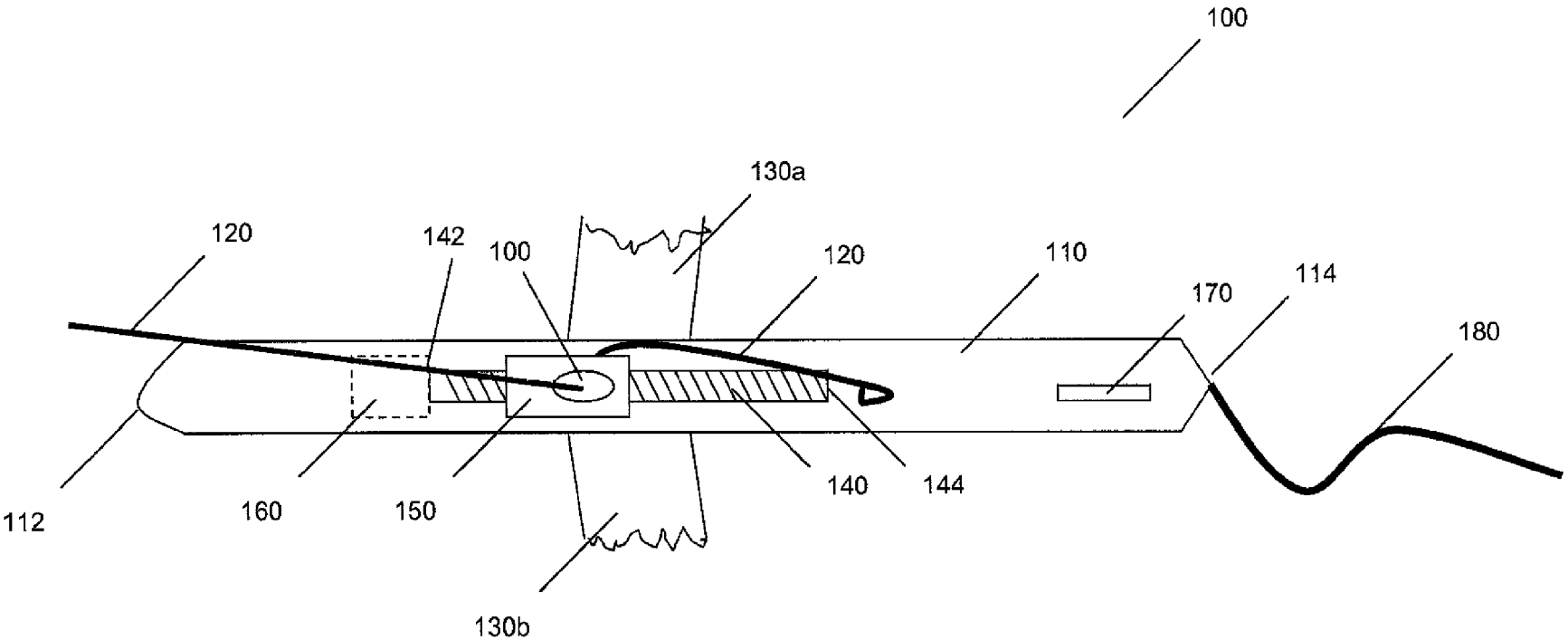
FIG. 1 is a diagram illustrating a top view of a towed array depressor in accordance with an exemplary embodiment of the invention.

Referring to FIG. 1, a diagram is shown illustrating a top view of a towed array depressor 100 in accordance with an exemplary embodiment of the invention. As shown, the exemplary depressor 100 comprises a body 110 having a forward end 112 and an aft end 114. The body 110 may be approximately three to four inches in diameter and approximately 30-40 inches in length. The depressor 100 further comprises two wings 130*a* and 130*b* extending from the sides of the body 110 of the depressor 100. The wings may span approximately 24 to 36 inches measured from port to starboard and approximately 6 inches in length measured from a forward end to an aft end. A vertical stabilizer 170 is located near the aft end 114 of the body 110 and extends from a top side of the body 110 of the depressor 100 to provide vertical stability. The towed array depressor 100 also includes a worm screw 140 adapted to be driven by a motor 160. By way of example only, the motor 160 may be a high-torque, low-speed electrical motor. The worm screw may be approximately one to two inches in diameter and twelve to eighteen inches in length. The worm screw 140 connects to the motor 160 at a first point labeled 142 and extends aftward to a second point 144. The worm screw 140 and motor 160 are housed substantially within the body 110 of the depressor 110. It is noted that while shown to be located forward of the worm screw 140, the motor 160 may alternatively be located aft of the worm screw 140. The depressor 100 further comprises a sled mechanism 150 which may be slidably coupled to a top side of the body 110 of the depressor and the worm screw 140 such that the sled mechanism 150 may be allowed to move between points 142 and 144 along the body 110 of the depressor 100. The sled mechanism 150 also has a vertical protrusion 152 for attaching a tow cable 120 to the depressor 100. The towed array 180 attaches to the depressor 100 at the aft end 114 of the body 110 of the depressor 100 as shown in FIG. 1. The body 110 and sled mechanism 150 of the towed array depressor 100 may be fabricated of steel of sufficient strength to act as a linkage to the towing cable 120 and the towed array 180 and to withstand a contingent water force exerted upon it.

Figure 2A:
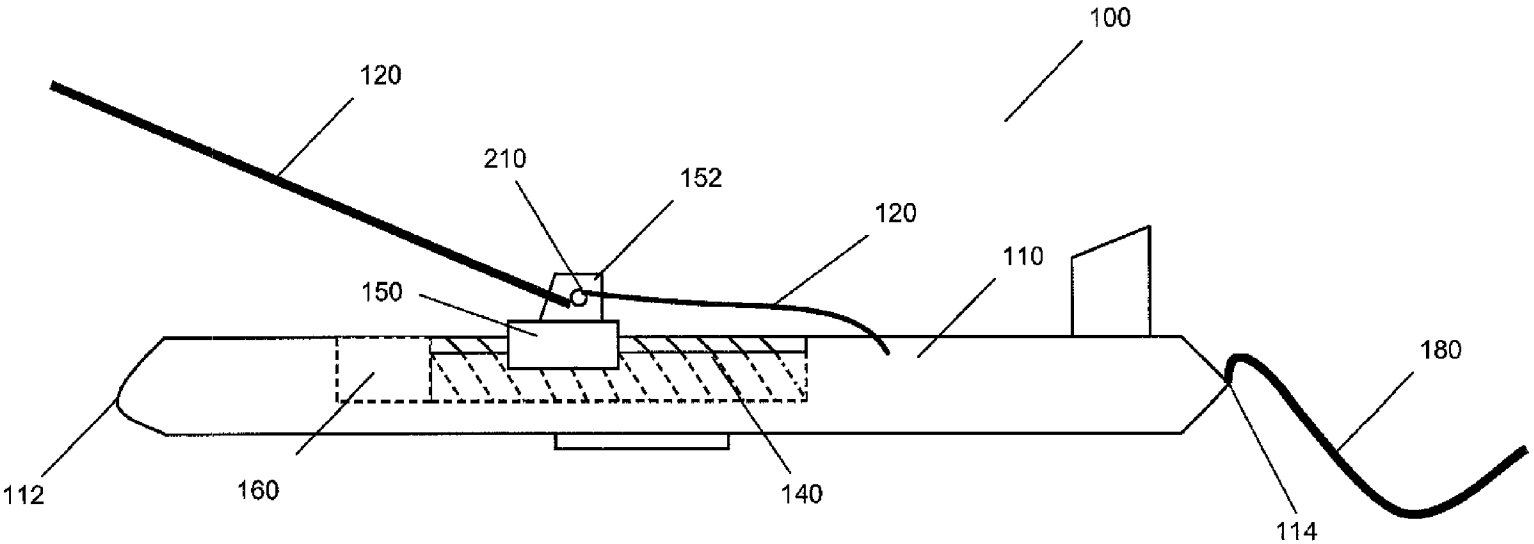
FIG. 2A is a diagram illustrating a side view of the exemplary towed array depressor of FIG. 1.

Referring now to FIG. 2A, a diagram is shown illustrating a side view of the exemplary towed array depressor 100 of FIG. 1. Tow cable 120 extends from a ship (not shown) and attaches through the vertical protrusion 152 of the sled mechanism 150 to form tow point 210. The location of the tow point 210 relative to a center of gravity of the depressor 100 affects the angle of attack of the wings 130*a* and 130*b*. Since the angle of attack of the wings 130*a* and 130*b* directly affects the depth of the depressor 100, modifying the location of the tow point 210 in turn allows the depth of the depressor 100 to be controlled. After attaching to the depressor 100 at tow point 210 the tow cable 120 then inserts into the body 110 of the depressor 100.

Figure 5:
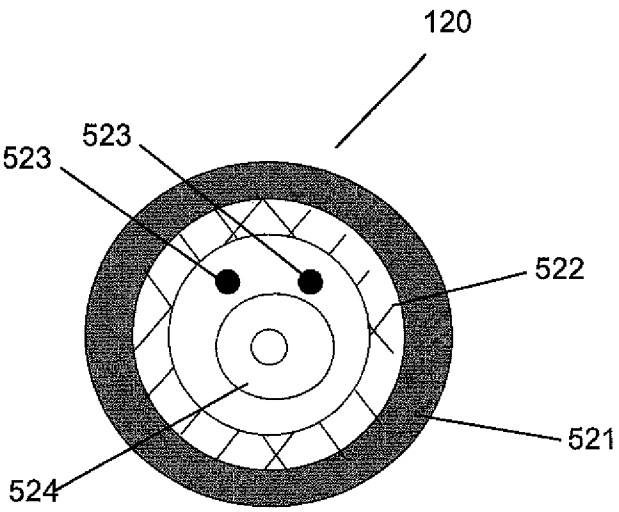
FIG. 5 is a diagram illustrating a cross section of an exemplary tow cable in accordance with the towed array depressor of FIG. 1

Referring now to FIG. 5, a diagram is shown illustrating a cross-section of an exemplary tow cable 120 is shown in accordance with the towed array depressor 100 of FIG. 1. By way of example only, the tow cable 120 may comprise a ruggedized coating 521, an armored sheath 522, copper lines 523 for carrying power, and a coaxial cable 524 for carrying electronic data. The tow cable may alternately include fiber-optic cable for carrying electronic data. The internal cables may comprise one or more lines for carrying power and communication to the depressor 100 including for example, copper, coaxial, fiber optic cable or any combination thereof.

Referring back to FIG. 2A, the tow cable 120 extends within the body 110 of the depressor 100 in order to carry power and electronic data to motor 160. Incorporation of the one or more conductive lines into tow cable 120 allows an operator onboard the ship to remotely operate the motor 160. In this manner the operator may remotely control the position of the tow point 210 relative to the center of gravity of the depressor 100 in turn allowing the operator to remotely control the depth of the depressor 100.

Figure 2B:
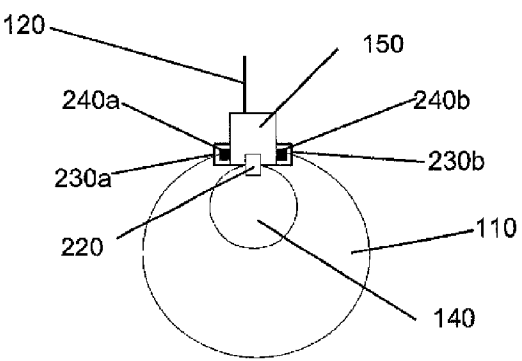
FIG. 2B is a diagram illustrating a cross section view of the exemplary towed array depressor of FIG. 1.

FIG. 2B shows a cross section view of the exemplary towed array depressor 100 of FIG. 1. As shown, the worm screw 140 and the sled mechanism 150 are positioned so that the worm screw 140 mates with the sled mechanism 150 by way of a series of geared notches 220 extending from the bottom of the sled mechanism 150. The geared notches 220 are sized to mesh with the worm screw 140. Geared notches 220 allow a rotational force of the worm screw 140 to be transferred to the sled to affect linear motion of the sled between points 142 and 144 along the body 110 of the depressor 100 (as shown in FIG. 2A). This allows the tow point 210 to be precisely controlled relative to the center of gravity of the depressor 100. The sled mechanism 150 also includes rail guides 230*a* and 230*b* that are adapted to mate with a set of rails 240*a* and 240*b*. The rails 240*a* and 240*b* are formed within the body 110 of the depressor 100 extending longitudinally between points 142 and 144. The rail guides 230*a* and 230*b* are configured to mate with the rails 240*a* and 240*b* to allow the sled mechanism 150 to travel linearly between points 142 and 144 along the body 110 of the depressor 100.

Figure 2C:
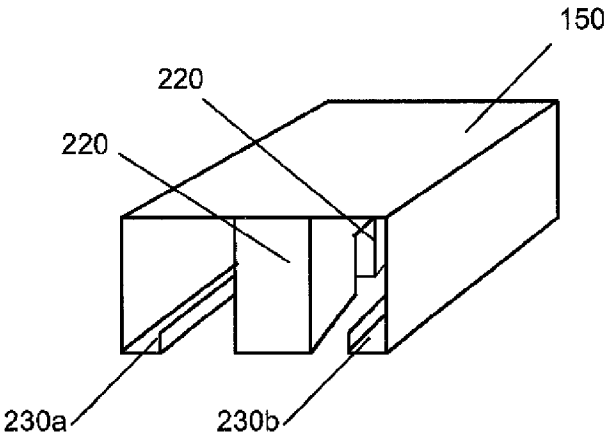
FIG. 2C is a diagram illustrating an isometric view of a sled drive mechanism in accordance with the exemplary towed array depressor of FIG. 1.
Figure 2D:
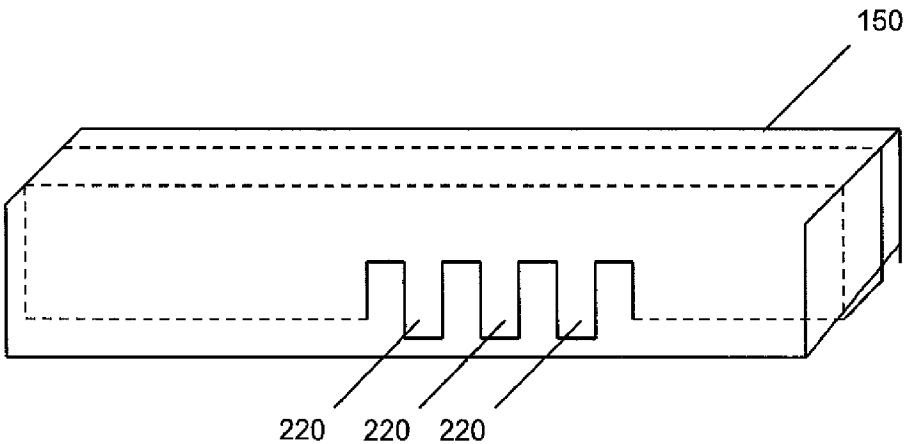
FIG. 2D is a diagram illustrating another isometric view of a sled drive mechanism in accordance with the exemplary towed array depressor of FIG. 1.

FIG. 2C and FIG. 2D illustrate isometric views of the sled mechanism 150 in accordance with the exemplary towed array depressor 100 of FIG. 1. The sled mechanism 150 may include a plurality of geared notches 220 to allow the sled to travel between points 142 and 144 along the body 110 of the depressor 100.

Figure 3A:
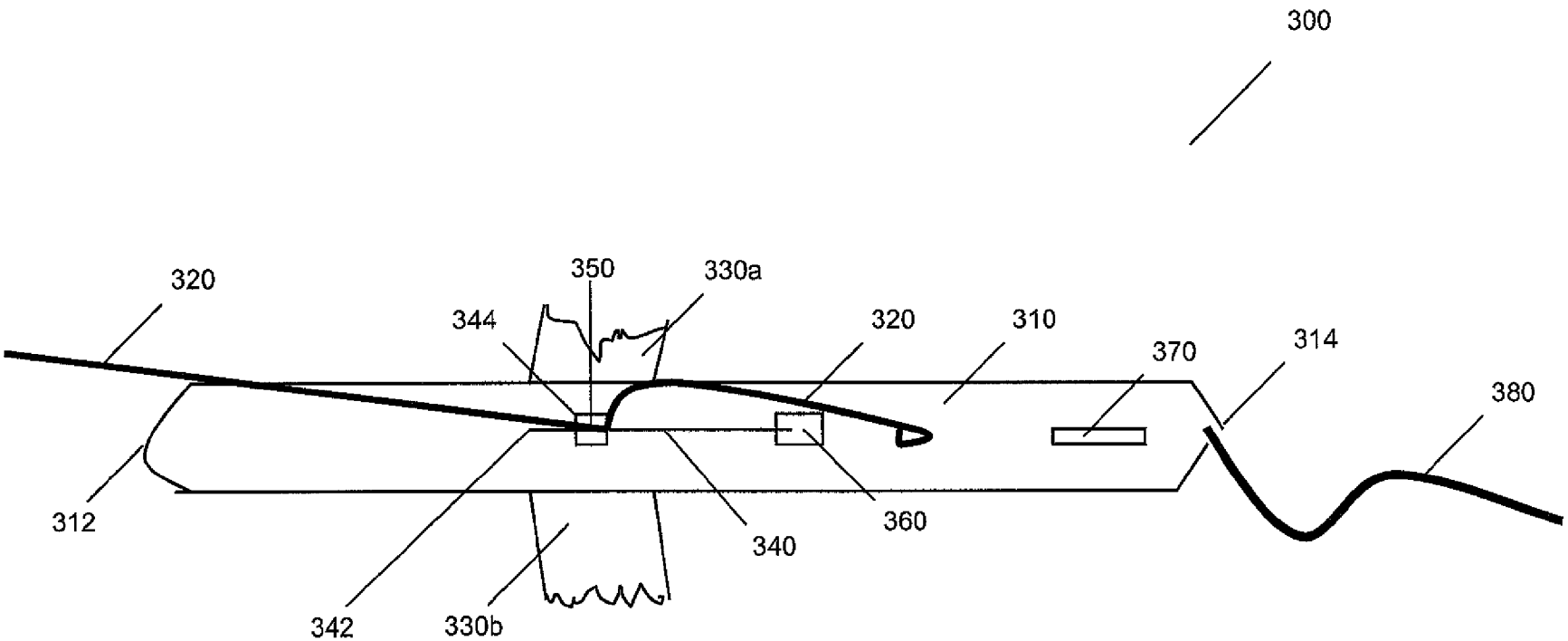
FIG. 3A is a diagram illustrating a top view of a towed array depressor in accordance with another exemplary embodiment of the invention.
Figure 3B:
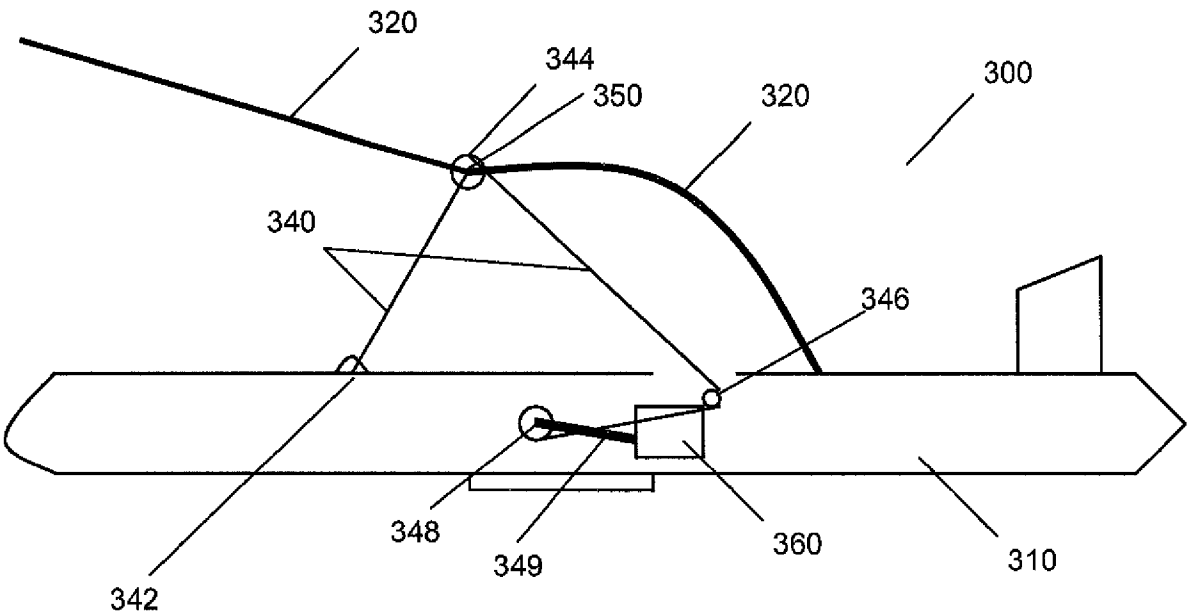
FIG. 3B is a diagram illustrating a side view of the exemplary towed array depressor of FIG. 3A.

Referring now to FIG. 3A, a diagram is shown illustrating a top view of a towed array depressor 300 in accordance with another exemplary embodiment of the invention. As shown, the exemplary towed array depressor 300 comprises a body 310 having a forward end 312 and an aft end 314. The depressor 300 further comprises two wings 330*a* and 330*b* extending from the sides of the body 310 of the depressor 300. A vertical stabilizer 370 is located near the aft end 314 of the body 310 and extends from a top side of the body 310 of the depressor 300 to provide vertical stability. A towed array 380 attaches to the depressor 300 at the aft end 314 of the body 310 of the depressor 300 as shown in FIG. 3. The depressor 300 also includes a pulley cable 340 adapted to be driven by a motor 360. By way of example only, the motor 360 may be a high-torque, low-speed electrical motor. The pulley cable 340 attaches to the body 310 of the depressor 300 at a fixed attachment point labeled as 342. The pulley cable 340 then extends to a second fixed attachment point 344 where the pulley cable 340 attaches to a tow cable 320 forming a tow point 350. By way of example only, the pulley cable 340 may be attached to the tow cable 320 by a bulls-eye type of linkage. The pulley cable 340 then extends within the body 310 of the depressor 300. By modifying the length of the pulley cable 340 the location of the tow point 350 can be controlled relative to the center of gravity of the depressor 300 allowing the angle of attack and in turn the depth of the depressor 300 to be controlled. Operation of the pulley will now be discussed in greater detail with reference to FIG. 3B.

FIG. 3B shows a side view of the exemplary towed array depressor 300 of FIG. 3A. Tow cable 320 extends from a ship (not shown) and attaches to the pulley cable 340 at second fixed attachment point 344 to form tow point 350. The pulley cable 340 then extends into the body 310 of the depressor 300 and wraps around a first pulley wheel labeled as 346. The pulley cable 340 then attaches to a pulley take-up reel 348. The pulley take-up reel 348 attaches to motor 360 by connecting rod 349 which allows the take-up reel 348 to be rotationally driven in either a clock-wise or counter-clockwise direction. In this manner the pulley cable 340 may be either reeled in, shortening the length of the pulley cable 340 between tow point 350 and pulley wheel 346, or reeled out, increasing the length of the pulley cable 340 between tow point 350 and pulley wheel 346. In this manner, the location of the tow point 350 may be controlled by motor 360. Since the location of the tow point 350 relative to a center of gravity of the depressor 300 affects the angle of attack of the wings 330*a* and 330*b* and the angle of attack of the wings 330*a* and 330*b* directly affects the depth of the depressor 300, modifying the length of the pulley cable 340 in turn allows the depth of the depressor 300 to be controlled. By way of example only, the tow cable 320 may comprise an electrical insulating layer and one or more internal cables (not shown) for carrying power and electronic data. The internal cables may comprise one or more lines for carrying power and communication to the depressor 300 including for example, copper, coaxial, fiber optic cable or any combination thereof. The tow cable 320 extends within the body of 310 of the depressor 300 in order to carry power and electronic data to motor 360. Incorporation of the one or more conductive lines into tow cable 320 allows an operator onboard a ship to remotely operate the motor 360. In this manner the operator may remotely control the position of the tow point 350 relative to the center of gravity of the depressor 300 in turn allowing remote control of the depth of the depressor 300 and towed array 380.

Figure 3C:
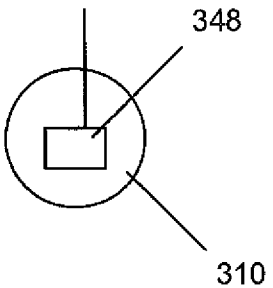
FIG. 3C is a diagram illustrating a cross section view of the exemplary towed array depressor of FIG. 3A.

Referring now to FIG. 3C, a diagram is shown illustrating a cross section view of the exemplary towed array depressor 300 of FIG. 3A. As shown, the take-up reel 348 is housed substantially within the body 310 of depressor 300.

Figure 4A:
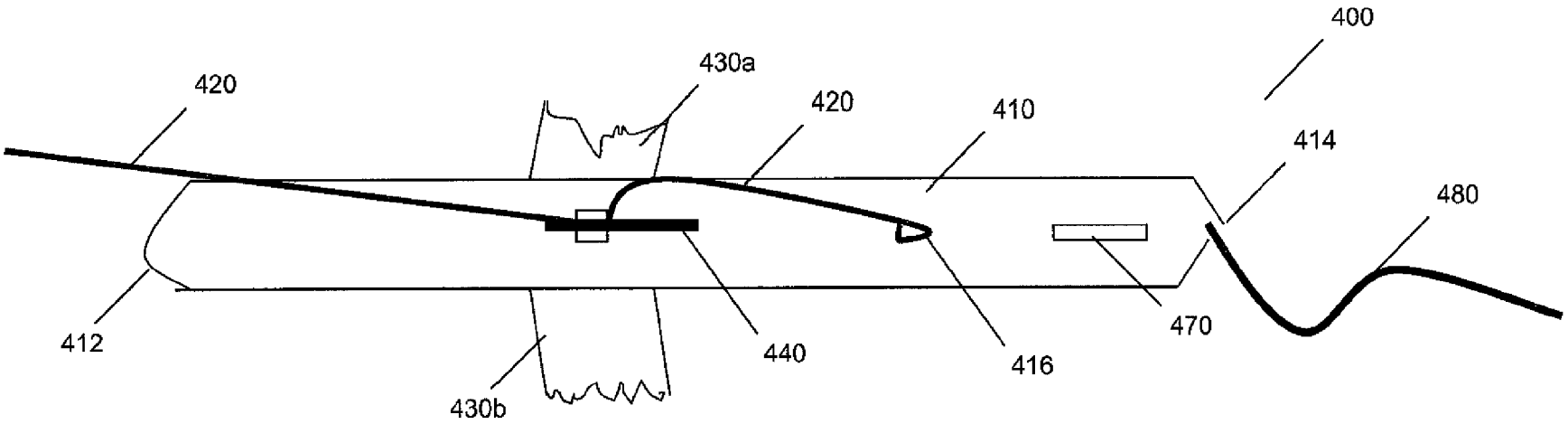
FIG. 4A is a diagram illustrating a top view of a towed array depressor in accordance with another exemplary embodiment of the invention.
Figure 4B:
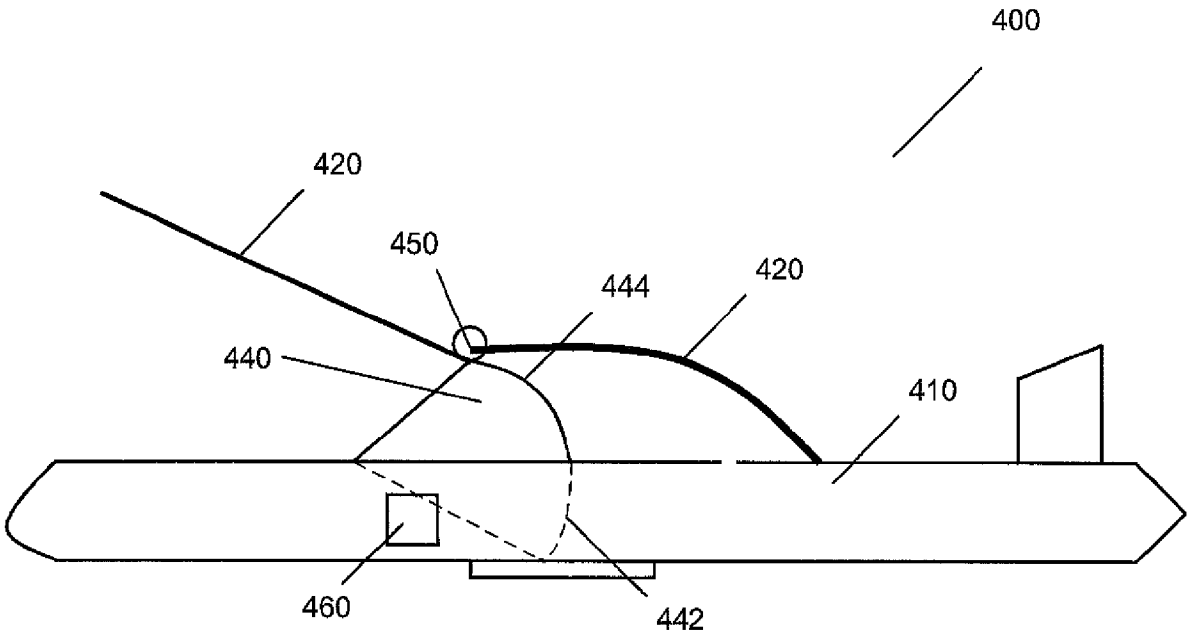
FIG. 4B is a diagram illustrating a side view of the exemplary towed array depressor of FIG. 4A.

Referring now to FIG. 4A, a diagram is shown illustrating a top view of a towed array depressor 400 in accordance with another exemplary embodiment of the invention. As shown, the exemplary towed array depressor 400 comprises a body 410 having a forward end 412 and an aft end 414. The depressor 400 further comprises two wings 430*a* and 430*b* extending from the sides of the body 410 of the depressor 400. A vertical stabilizer 470 is located near the aft end 414 of the body 410 and extends from a top side of the body 410 of the depressor 400 for providing vertical stability. A towed array 480 attaches to the depressor 400 at the aft end 414 of the body 410 of the depressor 400 as shown in FIG. 4. The depressor 400 also includes a fin 440 which is adapted to rotate from a position in which the fin is substantially enclosed within the body 410 of depressor 400 to a position in which the fin extends substantially above the surface of the body 410 of the depressor 400. The fin 440 may be rotationally driven by a motor 460. By way of example only the motor 460 may be a solenoid or stepping motor. The fin 440 attaches to a crankshaft of the motor 460 thereby allowing the motor to impart rotational motion to the fin 440. The depressor 400 also includes a tow cable 420 that extends from a ship (not shown) and attaches to the fin 440 to form a tow point 450. The tow cable 420 then attaches to the body 410 of the depressor 400 at fixed attachment point 416. By rotating fin 440 the location of the tow point 450 can be controlled relative to the center of gravity of the depressor 400 allowing the angle of attack and in turn the depth of the depressor 400 and towed array 480 to be controlled. Operation of the fin 440 will now be discussed in greater detail with reference to FIG. 4B.

FIG. 4B shows a side view of the exemplary towed array depressor 400 of FIG. 4A. Fin 440 is adapted to rotate from a first position 442 (shown having a dashed outline) in which the fin 440 is substantially enclosed within the body 410 of depressor 400 to a second position 444 in which the fin extends substantially above the surface of the body 410 of the depressor 400. It is noted that while two positions are shown, the fin may be rotated by motor 460 to any position between the first position 442 and the second position 444. As shown, tow cable 420 attaches to the fin 440 to form tow point 450, then extends within the body 410 of the depressor 400. In this manner, the location of the tow point 450 may be controlled by motor 460. Since the location of the tow point 450 relative to a center of gravity of the depressor 400 affects the angle of attack of the wings 430*a* and 430*b* and the angle of attack of the wings 430*a* and 430*b* directly affects the depth of the depressor 400, modifying the location of the tow point 450 in turn allows the depth of the depressor 400 to be controlled. By way of example only, the tow cable 420 may comprise an electrical insulating layer and one or more internal cables (not shown) for carrying power and electronic data. The internal cables may comprise one or more lines for carrying power and communication to the depressor 400 including for example, copper, coaxial, fiber optic cable or any combination thereof. The tow cable 420 extends within the body of 410 of the depressor 400 in order to carry power and electronic data to motor 460. Incorporation of the one or more conductive lines into tow cable 420 allows an operator onboard a ship to remotely operate the motor 460. In this manner the operator may remotely control the position of the tow point 450 relative to the center of gravity of the depressor 400 in turn allowing the operator to remotely control the depth of the depressor 400 and towed array 480.

Figure 4C:
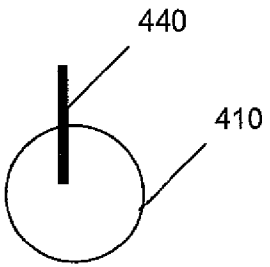
FIG. 4C is a diagram illustrating a cross section view of the exemplary towed array depressor of FIG. 4A.

Referring now to FIG. 4C, a diagram is shown illustrating a cross section view of the exemplary towed array depressor 400 of FIG. 4A. As shown, the fin is rotated to a position partially within the body 410 of depressor 400.

Thus, a towed array depressor is contemplated having the benefits of rapid reconfiguration and precise depth control. Traditional systems are currently incapable of operation in littoral waters where water depths are shallow and more variable. Critical angle towed array systems cannot be used because of the dependence on ship speed and cable length to control the depth of the towed hydrophone array and current depressors cannot be employed since manual reconfiguration of the depressor cannot be done quickly enough to adapt to the variable depths. The contemplated towed array depressor allows ships to deploy hydrophone arrays in littoral waters. A depressor for towed hydrophone arrays is contemplated having remotely controllable tow points which allows array depth to be modified without requiring manual reconfiguration of the depressors and additionally provides increased depth control precision as compared with previous designs.

While the foregoing invention has been described with reference to the above-described embodiments, various modifications and changes can be made without departing from the spirit of the invention. Accordingly, all such modifications and changes are considered to be within the scope of the appended claims.

What is claimed is:

1. A towed array depressor comprising:

a depressor body having an exterior surface defining lateral sides and a top surface, said to surface having a longitudinal opening defined there-through, wherein said longitudinal opening has a pair of longitudinal edges, said pair of longitudinal edges defining a pair of rails within said depressor body;

a pair of fixed wings extending from the lateral sides of said depressor body;

a coupling mechanism configured to be fixedly coupled to a tow cable and slidably coupled to the depressor body along a longitudinal axis of the depressor body, the coupling mechanism thereby adjustably coupling the tow cable to said depressor body at an adjustable tow point, said tow point remotely adjustable relative to a center of gravity of said depressor, wherein said coupling mechanism comprises a sled mechanism having rail guides configured to mate with said pair of rails within said depressor body and having geared notches; and a motor adapted to drive a worm screw, said motor and worm screw housed substantially within said depressor body, wherein said worm screw is positioned relative to said longitudinal opening and configured to mesh with said geared notches, and wherein said motor drives said worm screw for incrementally adjusting said position of the coupling mechanism along the longitudinal axis of the depressor body, and thereby adjusting the position of the tow point, said motor adapted to receive adjustment instructions remotely through said tow cable, wherein adjustment of said adjustable tow point relative to the center of gravity of the depressor changes an angle of attack of said pair of fixed wings to thereby control an operating depth of said depressor.

2. The towed array depressor of claim 1, wherein said coupling mechanism slidably couples said tow cable to said depressor body.

3. The towed array depressor of claim 2, wherein said coupling mechanism further comprises:

a cutout section for fixedly attaching said tow cable to said coupling mechanism.

4. A towed array depressor comprising:

a depressor body having an exterior surface defining lateral sides;

a pair of fixed wings extending from the lateral sides of said depressor body;

a coupling mechanism adapted to adjustably couple a tow cable to said depressor body at an adjustable tow point, said tow point remotely adjustable relative to a center of gravity of said depressor; and a motor for incrementally adjusting said coupling mechanism, said motor adapted to receive adjustment instructions remotely through said tow cable, wherein adjustment of said adjustable tow point relative to the center of gravity of the depressor changes an angle of attack of said pair of fixed wings to thereby control an operating depth of said depressor, wherein said coupling mechanism rotationally couples said tow cable to said depressor body and said coupling mechanism further comprises:

a pulley reel coupled to said motor by a connecting rod; and a pulley cable having a first section fixedly attached to said depressor body, a second section capable of being fixedly attached to said tow cable and a third section fixedly attached to said pulley reel.

5. A towed array depressor comprising:

a depressor body having an exterior surface defining lateral sides;

a pair of fixed wings extending from the lateral sides of said depressor body;

a coupling mechanism adapted to adjustably couple a tow cable to said depressor body at an adjustable tow point, said tow point remotely adjustable relative to a center of gravity of said depressor; and a motor for incrementally adjusting said coupling mechanism, said motor adapted to receive adjustment instructions remotely through said tow cable, wherein adjustment of said adjustable tow point relative to the center of gravity of the depressor changes an angle of attack of said pair of fixed wings to thereby control an operating depth of said depressor, wherein said coupling mechanism rotationally couples said tow cable to said depressor body and said coupling mechanism further comprises:

a fin coupled to said motor, said fin having a cutout section for fixedly attaching said tow cable to said coupling mechanism;

wherein said fin is adapted to receive a rotational force imparted by said motor and upon receiving said rotational force, rotate between a first position in which said fin is substantially enclosed within said depressor body and a second position in which said fin extends substantially above the surface of said depressor body.

6. The towed array depressor of claim 4, wherein said motor is adapted to receive power remotely through said tow cable.

7. A towed array depressor comprising:

a depressor body having an exterior surface defining lateral sides;

a pair of fixed wings extending from the lateral sides of said depressor body; and an attachment mechanism having a tow cable attachment element for attaching a tow cable to the attachment mechanism, said attachment mechanism adapted to be adjustably attached to said depressor body to allow a location of the tow cable attachment element to be incrementally adjustable relative to a center of gravity of said depressor body, wherein adjustment of said attachment mechanism relative to the center of gravity of the depressor body changes an angle of attack of said pair of fixed wings to thereby control an operating depth of said depressor;

a motor for adjusting said attachment mechanism;

wherein said attachment mechanism rotationally attaches to said depressor body and wherein said attachment mechanism further comprises:

a pulley reel coupled to said motor by a connecting rod; and a pulley cable having a first section fixedly attached to said depressor body, a second section capable of being fixedly attached to said tow cable and a third section fixedly attached to said pulley reel.

8. A towed array depressor comprising:

a depressor body having an exterior surface defining lateral sides;

a pair of fixed wings extending from the lateral sides of said depressor body; and an attachment mechanism having a tow cable attachment element for attaching a tow cable to the attachment mechanism, said attachment mechanism adapted to be adjustably attached to said depressor body to allow a location of the tow cable attachment element to be incrementally adjustable relative to a center of gravity of said depressor body, wherein adjustment of said attachment mechanism relative to the center of gravity of the depressor body changes an angle of attack of said pair of fixed wings to thereby control an operating depth of said depressor;

a motor for adjusting said attachment mechanism;

wherein said attachment mechanism, wherein said attachment mechanism further comprises:

a fin coupled to said motor, said fin having a cutout section for fixedly attaching said tow cable to said attachment mechanism;

wherein said fin is adapted to receive a rotational force imparted by said motor and upon receiving said rotational force, rotate between a first position in which said fin is substantially enclosed with said depressor body and a second position in which said fin extends substantially above the surface of said depressor body.

9. A towed array depressor comprising:

a body having a longitudinal opening through a top surface of said body, wherein the longitudinal opening has a pair of longitudinal edges defining a pair of rails within said body;

one or more winged sections coupled to said body;

a worm screw housed substantially within said body and disposed relative to said longitudinal opening;

a motor substantially housed within said body and coupled to said worm screw; and a sled mechanism having rail guides that matingly engage said rails for slidably coupling said sled mechanism to said body along a longitudinal path on top of said body, one or more notched sections for meshing with said worm screw to allow a rotational force of the worm screw to be transferred to the sled mechanism to effect linear motion and an attachment section for attaching a tow cable to said sled mechanism wherein sliding said sled mechanism along the longitudinal path on top of said body changes a position of said attachment section relative to a center of gravity of said depressor, and changes an angle of attack of said one or more winged sections, thereby controlling an operating depth of said depressor.

* * * * *

UNITED STATES PATENT AND TRADEMARK OFFICE

CERTIFICATE OF CORRECTION

PATENT NO. : 8,479,676 B2
APPLICATION NO. : 12/412151
DATED : July 9, 2013
INVENTOR(S) : Thaddeus J. Kurpiewski It is certified that error appears in the above-identified patent and that said Letters Patent is hereby corrected as shown below:

In the Claims:

Column 6, Line 4, Claim 1, the word “to” should read “top”.

Signed and Sealed this
Twentieth Day of August, 2013

Teresa Stanek Rea
*Acting Director of the United States Patent and Trademark Office*